United States Patent [19]

Kessler

[11] Patent Number: 4,551,376

[45] Date of Patent: Nov. 5, 1985

[54] LUBRICATED FIN PILE-TYPE WEATHERSTRIP

[76] Inventor: Milton Kessler, 302 McClurg Rd., Youngstown, Ohio 44501

[21] Appl. No.: 731,376

[22] Filed: May 7, 1985

[51] Int. Cl.[4] ..... D04H 11/00; E06B 7/22

[52] U.S. Cl. ..... 428/85; 428/88; 428/89; 428/90; 428/92; 428/93; 428/94; 428/96

[58] Field of Search ..... 428/85, 88, 89, 90, 428/92, 93, 94, 96

[56] References Cited

U.S. PATENT DOCUMENTS

| | | | |
|---|---|---|---|
| 3,175,256 | 3/1965 | Horton | 49/489 |
| 3,745,053 | 7/1973 | Johnson | 428/85 |
| 4,242,392 | 12/1980 | Yackiw | 428/85 |

*Primary Examiner*—Marion E. McCamish
*Attorney, Agent, or Firm*—Browdy & Neimark

[57] ABSTRACT

An improved pile-type, fin weatherstrip includes an elongated V- or U-shaped barrier fin bonded to a base strip and located between a pair of upstanding pile fiber arrays. The barrier fin is formed of thermoplastic film which is preferably smooth, but which may be roughened, dimpled or otherwise provided with a large number of pockets, or which may have a flocked surface. A lubricant grease is provided in the channel shaped cavity of the barrier fin, which lubricant is progressively dispensed in response to a wiping action type of movement which occurs when the barrier fin is compressed by the pile arrays during usage. The lubricant grease is exuded progressively over the useful life of the weatherstrip toward the free edges of the barrier fin located at or near the forward projecting face of the weatherstrip where such grease is dispensed in small amounts to decrease breakaway force, lower sliding friction and improved air infiltration characteristics. The barrier fin may be perforated so that lubricant grease is also forced into the fibers of the pile arrays where it will also work to the surface of the weatherstrip and improve the aforementioned properties.

20 Claims, 6 Drawing Figures

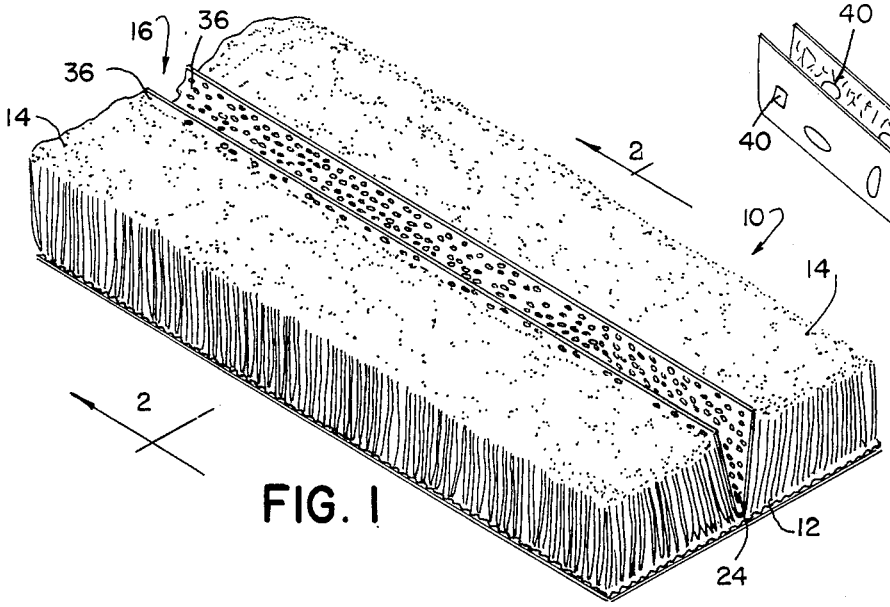
FIG. 1
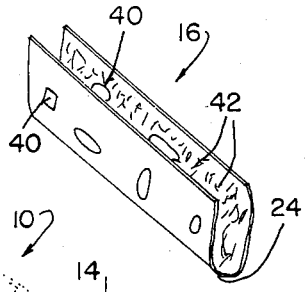
FIG. 6
FIG. 3
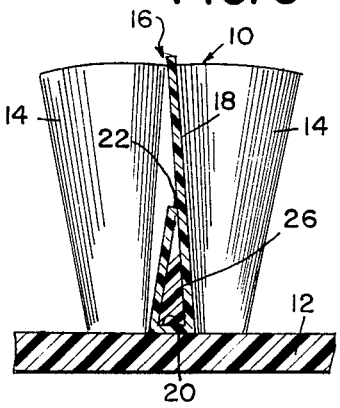
FIG. 4
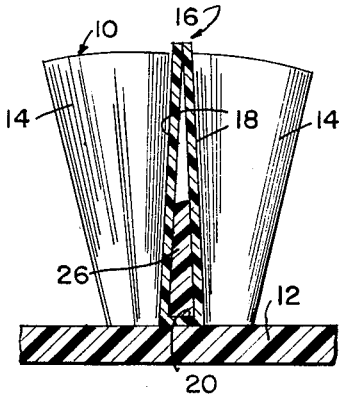
FIG. 5
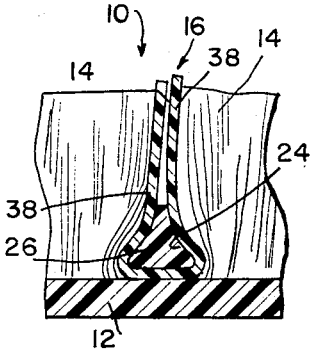
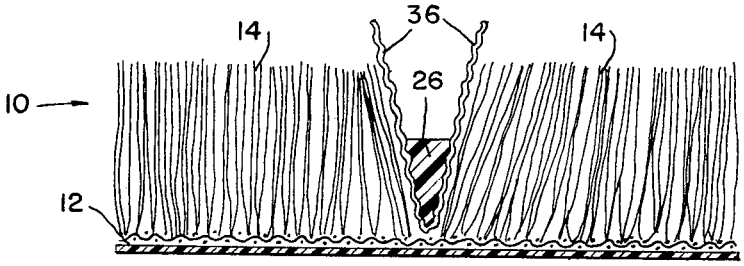
FIG. 2

LUBRICATED FIN PILE-TYPE WEATHERSTRIP

FIELD OF INVENTION

The present invention relates to weatherstripping, and more particularly to an improved pile-type weatherstripping incorporating a barrier fin.

BACKGROUND

Weatherstripping material is important in the conservation of energy and is used to provide a barrier to air between a variety of fixed and movable elements, such as between slidable or swingable elements including windows or doors and the like, and the fixed elements within which they are mounted for movement. The best type of weatherstripping barrier is a solid element, such as a plastomeric or elastomeric fin or the like, which presents a solid barrier to prevent the passage of cold air from one side of the weatherstripping, or warm air from the other side. Such weatherstripping material has been known and used for many years. A more recent development is the so-called pile-type of weatherstripping, the major advantage of which is its high customer acceptance; in essence, pile-type weatherstripping has achieved its great success because the ultimate customer, i.e. the consumer, likes the way it looks.

However, one of the problems with pile-type weatherstripping was that the pile fibers permitted the passage therethrough of air, and therefore this type of weatherstripping in some environments failed to provide a solution for the very problem for which it was needed, namely to provide an air barrier. This problem was essentially solved by the 1965 Horton U.S. Pat. No. 3,175,256, which provided an impervious barrier fin within the pile. The product of Horton thus combined the air impervious fin with the attractive pile material.

When using a pile-type of weatherstripping such as shown in the Horton patent, the surface against which the top end of the weatherstripping should seal, should be spaced from the surface in which the weatherstripping is mounted by a distance equal to the height of the weatherstripping. In actual practice, however, installers of windows and doors are seldom sufficiently careful to provide this spacing; and the tendancy, in order to avoid a gap between the top of the weatherstripping and the opposite surface against which it is to seal, is to make the distance less than the height of the weatherstripping, thereby causing a compression of the weatherstripping during use. When the weatherstripping is so compressed, there is often created a substantial frictional drag which may be considerable from the point of view of the consumer, because substantial breakaway force may be required to move the movable element (e.g. a sliding window) from the fixed element (e.g. the window frame). This may be an especially difficult problem for children, the elderly, handicapped or other persons with little strength.

One partial solution to this problem which has been in common use for many years is to extend the height of the film in the Horton weatherstripping above the height of the pile. This expedient permits the installer a somewhat larger margin of error, because the sliding or moving surface (e.g. the contacting surface of the window or door) can be located anywhere between the top of the pile and the top of the fin. This expedient is not entirely satisfactory, however, because the appearance is sometimes less than satisfactory and if the installer continues to compress the pile, the problem of excessive breakaway force continues to exist.

The U.S. Patent to Yackiw No. 4,242,392 is of interest in showing a pile-type, fin weatherstripping material wherein the upwardly projecting, fin is formed of a porous material impregnated with paraffin, the paraffin being stated to act as a lubricant for the sliding surface against which the weatherstripping material seals. However, insofar as is known, this product has apparently not been satisfactory and has never entered the marketplace. In use, the paraffin lubricant would soon rub off the exposed tip of the fin and there is no means provided for supplying lubricant over an extended period of time.

Another patent of interest is the Johnson et al U.S. Pat. No. 3,745,053. This patent describes an embodiment in FIG. 6 where a space is provided beneath the barrier fin, and the space is filled with a non-adhesive gasket material such as grease, wax or silicone grease, in order to seal such space between the barrier fin and the base. It is evident that such non-adhesive gasket material, even if it is a grease, is not a lubricating grease and is not of a character, and not placed in a proper position, so that it may migrate from its desired location between the barrier fin and the base to a location where it might act as a lubricant.

The need continues to exist for a pile-type, fin weatherstrip which is more tolerant of improper installation, i.e. one that can be placed under substantial compression due to faulty installation, yet will not result in the creation of so much friction that the breakaway force required to open a sliding door or window becomes a problem to any member of the consuming public.

SUMMARY OF THE INVENTION

It is, accordingly, an object of the invention to overcome defficiencies in the prior art, such as indicated above.

It is another object to provide for the improved sealing from the outside environment of buildings and rooms and other enclosures to prevent the leakage of air around the edges of windows, doors or the like.

It is a further object to provide for improved weatherstripping material especially useful with windows or doors.

It is yet another object to provide a improved pile-type, fin weatherstripping material.

It is yet a further object to provide a lubricated pile-type, fin weatherstripping material.

It is still another object to provide a weatherstripping material having a base from which a pile fabric projects upwardly, such pile extending on both sides of a generally U-shaped impervious barrier film also projecting upwardly from the base, and wherein the U-shaped cavity, acting as reservoir, contains a supply of lubricating grease which will not liquidfy under ambient conditions, and which grease is squeezed in minute amounts to the top edge of the fin and to the top surface of the pile during repeated deformations of the pile, during opening and closing of the window, door or the like, whereby the weatherstripping becomes lubricated and the problem of undue breakaway force is continuously avoided over the life of the weatherstripping.

These objects are briefly accomplished according to the invention by providing a pile-type, fin weatherstripping which reduces breakaway force. The fin, which has pile extending upwardly on both sides, is U or V shaped to form a cavity therein, which cavity is filled with a suitable lubricating grease, such as a high viscosity silicone libricating grease. The viscosity of the grease is sufficiently high so that it is squeezed out through the opening at the top of the U shaped fin only with some difficulty, and is also of a character so that it does not liquify under conditions of normal usage. As the pile material is compressed during repeated openings and closings of the door or window, it presses against the U-shaped fin and small amounts of the grease are squeezed out to the ends of the fins to thereby provide lubrication and obviate the problem of undue friction between the sliding door or window and its frame.

The above and other objects and the nature and advantages of the instant invention will be more apparent from the following detailed description of certain embodiments of the invention, taken into conjunction with the drawing, wherein:

BRIEF DESCRIPTION OF DRAWING

FIG. 1 is a perspective view of a first embodiment according to the instant invention;

FIG. 2 is a sectional view taken along line 2—2 of FIG. 1;

FIG. 3 is a sectional view similar to FIG. 2, but showing another embodiment;

FIG. 4 is another sectional view like FIGS. 2 and 3, but showing a further embodiment;

FIG. 5 is a sectional view like FIGS. 2–4 showing the embodiment of FIG. 4 after some usage; and FIG. 6 is a schematic perspective view of a fin for use in the invention, which fin incorporates various additional options.

DETAILED DESCRIPTION OF EMBODIMENTS

Referring to the figures, there is shown a series of embodiments of a weatherstrip 10 according to the instant invention. In general, the weatherstrip 10 includes an elongated strip of base material 12 and arrays of upstanding pile fibers 14 which are located on opposite sides of a V or U shaped barrier fin 16, the cavity 24 of which serves as a reservoir for a lubricating grease 26. The barrier fin 16 is connected in any conventional way, such as by ultrasonic welding along surface 20, to the base 12.

The base strip 12 may be formed of any suitable material, such as woven fabric, plastic or even metal. It may be a unitary layer of extruded thermoplastic material or it may be a laminate of a woven thermoplastic fabric with an impervious layer therebeneath such as shown in FIGS. 1 and 2, or alternatively the woven fabric may merely be coated on its underside with a suitable impervious material such as polypropylene which will serve to impede the penetration of moisture by a wicking action which might otherwise serve to transmit moisture from one side to the other side of the base 12. It should be understood that the base 12 can take any conventional form.

Similarly, the arrays of pile 14 may be in accordance with conventional practice in the field. Usually, as best shown in FIG. 2, the pile 14 is formed integral with a woven base 12, and of conventional pile fibers normally used for this purpose, consistent with conventional practice. It will be understood that in practice the height of the pile may vary, and normally the weatherstripping 10 may be provided in different pile heights, also consistent with conventional practice. Also as is conventional, the fibers of the pile 12 have the characteristic of resiliency, and have sufficient memory to return themselves to their original upstanding position even though they may undergo deformation for extended periods during use.

The barrier fin 16 may take various forms. In the embodiment of FIGS. 1 and 2, such barrier fin 16 assumes a generally V-shaped configuration having legs 36 of equal length. These legs 36, indeed the entire barrier fin 16 in the embodiment of FIGS. 1 and 2, is formed of a thermoplastic material having impressed or embossed therein or thereon a plurality of dimples, pockets, recesses or other surface irregularities capable of receiving, retaining and progressively dispensing lubricant in response to a wiping action type of movement which occurs when the ends of the legs 36 are moved relative to each other as an engaging structure moves over and across the width of the weatherstrip 10. As shown in FIG. 2, the lubricant grease 26 may be initialy placed in the apex of the V of the legs 36.

In the embodiment of FIG. 3, one leg 18 of the barrier fin 16 extends full height to the top of the pile or therebeyond, while the other leg 22 is shortened. Even so, there is a sufficient reservoir between the two legs to maintain the grease 26. As the pile arrays 14 are moved back and forth and pushed against the fin 16, the grease is exuded along the line of contact 28 between the leg 18 and the end of the leg 22, and then eventually travels along the side of the leg 18 until it reaches the top of the pile at which point it is capable of performing the desired lubricating function. Moreover, the lubricating grease may also wet the pile the fibers and migrate to the top thereof, where additional lubrication is thus provided.

In the embodiment of FIGS. 4 and 5, both legs 18 are of the same height. In essence, FIG. 4 shows the preferred embodiment immediately after manufacture thereof, whereas FIG. 5 shows the same embodiment after a period of time has passed during which the cross-sectional shape of the reservoir 24 has changed after repeated movements to provide a more or less delta configuration.

FIG. 6 is a partial schematic view incorporating several other options for the barrier fin 16, which options may be used individually or in combination. As shown in FIG. 6, the barrier fin 16 may be provided with a plurality of openings 40 cut therethrough along the length thereof. These openings may be, as illustrated, of various shapes (rectangular, oval, ellipsoidal, circular, etc.), sizes and locations. The purpose of the openings 40, which alternatively may be merely slits, is to permit lubricating grease to exude therethrough where it will coat the sides of the pile fibers of the arrays 14. As indicated above with respect to the embodiment of FIG. 3, such lubricating grease will work its way to the top of the arrays 14 thereby providing an additional lubricating function at the tops of the pile arrays 14. When the fin 16 has such openings 40, it may be desirable to use a larger quantity of lubricating grease, preferably on the order of 10–60 percent more than when no openings 40 are provided.

Another option shown in FIG. 6 is that of providing the interior surface of the U-shaped fin 16 with a flocked surface. Flocked plastic film is available commercially and may be used in the present environment; alternatively, the flocked film may be easily made by conventional bonding techniques using adhesives or thermoplastic welding techniques, particularly if the flock particles or fibrils 42 are thermoplastic. The presence of the flocked particles 42 help to control the flow of grease upwardly to the opening at the top of the U-shaped fin 16, acting as restricting means for the upward flow of lubricating grease. Alternatively, a fin material having internal longitudinally extending ridges can instead be used as such restricting means.

Selection of a suitable lubricating grease to give good results is important. As a general rule, the viscosity of the grease should be sufficiently high so that it is squeezed out of the U-shaped channel of the fin 16 only with some difficulty; it should also be of a character so that it does not liquify under conditions of normal usage, up to a temperature of at least about 150° F. In addition, the grease should be colorless, or it may be pigmented to match the color of the frame of the door or the window with which the weatherstripping is used. With these parameters in mind, the person of ordinary skill in the art will be able to select a suitable lubricating grease.

Suitable examples are Dow Corning silicone greases numbers 33 and 34. Another suitable grease is obtained by mixing synthetic motor oil (e.g. Mobile-1) with a thixotropic agent such as Cab-O-Sil or Hi-Sil T 600 (PPG). It is also desirable to add a fragrance to the lubricating grease to mask any objectable odors from other materials used in the construction of the window or door, such as corner sealants and vinyl plastics, and to give the window or door a "new window smell".

The present invention not only provides the advantages set forth above, namely decreasing breakaway force required to open sliding windows and doors due to faulty installation, but also lowers sliding friction in general and improves air infiltration characteristics.

If desired lubricating grease can also be supplied to the tips of the pile itself, thereby further reducing friction and improving air and water resistance. This can be accomplished by applying the lubricating grease to the tips of the pile fibers under pressure, thereby forcing the lubricating grease into the space between the individual pile fibers.

In operation, and after installation of the weatherstripping, the sliding of the window or the door against the weatherstripping when the window or door is opened or closed causes the pile fiber arrays 14 to push together. This pushing together of the pile arrays 14 in turn squeezes the U-shape barrier fin 15 and causes the lubricating grease to be exuded from between the legs of the barrier fin 16. The repeated rubbing action in use, both in the transverse and longitudinal directions, causes small amounts of the lubricating grease to be driven to the tips of the legs of the barrier fin 16, where the grease is put to its lubricating function.

The weatherstripping of the present invention may be made in a variety of ways. As indicated above, the barrier fin 16 may be ultrasonically welded as at location 20 to the base 12 in a conventional way. Such ultrasonic welding may be carried out continuously using a wheel and upstream of the wheel may be placed a grease injection nozzle or extruder which fills the reservoir 24 to the desired level, e.g. to a level about 20%–70% to the top, immediately after the barrier fin 16 has been welded in place.

Another option is that disclosed in my co-pending application Ser. No. 482,992, filed Apr. 7, 1983, which is hereby incorporated by reference. Bonding of the barrier fin 16 to the base strip 12 may be effected by heat softening a longitudinally extending portion of the fin, bringing the heat softened portion of the film into contact with the base strip, and maintaining this contact until sufficient cooling has taken place to assure that a secure bond has been formed between the barrier fin and the base strip, such heat softening being desirably achieved through the application of one or more fluids at least one of which has been heated to a temperature of sufficient magnitude to effect heat softening of the desired portion of the barrier fin without causing it to rupture. Indeed, one of the fluids may be the lubricant grease itself.

Adhesives may also be used to bond the barrier fin 16 preferrably to the base 12. After bonding, the lubricating grease may then be continuously injected within the channel reservoir 24 as indicated above. While the present invention has been described in conjunction with several embodiments which utilize a barrier fin structure positioned between spaced rows of fibers and bonded to a base, it will be understood that variations are possible without departing from the invention. For example, the present invention can be utilized to position other types of barrier fin configurations at locations other than between spaced rows of upstanding fibers, for example alongside or among fibers of a single row and/or to position a plurality of barrier fins between, alongside of or among fibers of a plurality of rows to form weatherstrips of a variety of configurations.

The foregoing description of the specific embodiments will so fully reveal the general nature of the invention that others can, by applying current knowledge, readily modify and/or adapt such specific embodiments without departing from the generic concept, and therefore such adaptations and modifications should and are intended to be comprehended within the meaning and range of equivalents of the disclosed embodiments. It is to be understood that the phasiology or terminology employed herein is for the purpose of description and not of limitation.

What is claimed is:

1. A weatherstrip of the fin, pile-type, comprising:

a base strip;

a longitudinally extending row of pile attached to said base strip;

a barrier fin of generally U or V shaped configuration secured in an upright orientation along said base strip adjacent said row of pile, with legs of said barrier fin defining therebetween an elongated reservoir; and a lubricating grease within the reservoir defined by the legs of said barrier strip, said lubricating grease having a viscosity sufficiently high so that it is squeezed out of the reservoir only with some difficulty, and having a liquification temperature sufficiently high so that it does not liquify under conditions of normal usage.

2. A weatherstrip according to claim 1 wherein the legs of said barrier fin are approximately the same height.

3. A weatherstrip according to claim 1 wherein one of the legs of said barrier fin extends higher than the other leg.

4. A weatherstrip according to claim 1 wherein the interior face of said barrier fin is provided with restricting means to inhibit movement of grease upwardly.

5. A weatherstrip according to claim 4 wherein said restricting means comprises a flocked surface.

6. A weatherstrip according to claim 1 wherein said barrier fin is provided with openings extending therethrough.

7. A weatherstrip according to claim 1 wherein said barrier fin is provided with a plurality of pockets or recesses at least along the interior surface thereof.

8. A weatherstrip according to claim 1 wherein said lubricant grease contains a fragrance.

9. A weatherstrip according to claim 1 wherein said lubricant grease is pigmented.

10. A weatherstrip according to claim 1 comprising two said rows of pile, with said barrier fin being disposed therebetween.

11. A weatherstrip for sealing a gap between relatively movable members, comprising:

a longitudinally extending backing strip for securing said weatherstrip to one of said relatively movable members;

a pair of longitudinally extending sealing bodies each having one surface portion thereof fixed to a face of said backing strip and cooperating therewith for forming sealing means, said sealing body extending from said face of said backing strip toward the other of said members to substantially close said gap between said members;

a generally U or V configured flexible film fixed between said sealing bodies and projecting upwardly so as to define an upwardly facing channel reservoir, said flexible film defining a barrier fin; and a lubricating grease within the upwardly facing channel reservoir of said barrier fin, said lubricating grease being colorless or pigmented to a preselected color and having a liquification temperature of at least 150° F.

12. A weatherstrip according to claim 11 wherein at least one of said sealing bodies comprises a pile fiber array.

13. A weatherstrip according to claim 12 wherein legs of said barrier fin are approximately the same height.

14. A weatherstrip according to claim 12 wherein one of the legs of said barrier fin extends higher than the other leg.

15. A weatherstrip according to claim 12 wherein the interior face of said barrier fin is provided with restricting means to inhibit movement of grease upwardly.

16. A weatherstrip according to claim 15 wherein said restricting means comprises a flocked surface.

17. A weatherstrip according to claim 12 wherein said barrier fin is provided with openings extending therethrough.

18. A weatherstrip according to claim 12 wherein said barrier fin is provided with a plurality of pockets or recesses at least along the interior surface thereof.

19. A weatherstrip according to claim 12 wherein said lubricant grease contains a fragrance.

20. A weatherstrip according to claim 12 wherein said lubricant grease is pigmented.

* * * * *